US005819764A

United States Patent [19]

Sussman

[11] Patent Number: 5,819,764

[45] Date of Patent: Oct. 13, 1998

[54] HERMETICALLY-SEALED COSMETIC COMPACT

[76] Inventor: Morris Sussman, 50 Doxsee Dr., Freeport, N.Y. 11520

[21] Appl. No.: 954,118

[22] Filed: Oct. 20, 1997

[51] Int. Cl.[6] ..... A45D 33/26

[52] U.S. Cl. ..... 132/293; 132/303

[58] Field of Search ..... 132/303, 293, 132/294, 295, 296, 301, 304, 305, 314, 315, 316; 220/806, 795, 344; 215/341, 343, 349; 206/823, 581

[56] References Cited

U.S. PATENT DOCUMENTS

| | | | |
|---|---|---|---|
| 2,315,647 | 4/1943 | Nyden | 132/305 |
| 2,424,817 | 7/1947 | Grassi | 132/305 |
| 2,737,189 | 3/1956 | Morningstar et al. | 132/305 |
| 4,586,519 | 5/1986 | Seidler et al. | 132/293 |
| 4,681,127 | 7/1987 | Gueret | 132/301 |
| 5,353,818 | 10/1994 | Suzuki et al. | 132/294 |

FOREIGN PATENT DOCUMENTS

| | | | |
|---|---|---|---|
| 2558045 | 7/1985 | France | 132/314 |

*Primary Examiner*—Todd E. Manahan
*Assistant Examiner*—Eduardo C. Robert
*Attorney, Agent, or Firm*—Michael Ebert

[57] ABSTRACT

A compact adapted to package a cosmetic in paste or cream form that includes volatile agents, the cosmetic package being hermetically sealed to prolong its shelf-life. The compact is provided with a case on whose base is anchored a cylindrical shell for storing the cosmetic. Surrounding the shell is an elastomeric sealing collar having a circular array of elastomeric legs extending from its lower edge and resting on the base of the case. Formed on the inner surface of the lid is a circular pressure ring which when the lid is swung down to close the compact then engages and applies downward pressure to the upper edge of the sealing collar to hermetically seal the cosmetic stored in the shell. This action compresses the legs which then exert an upward pressure on the collar to tighten its engagement with the ring and thereby strengthen the seal.

6 Claims, 2 Drawing Sheets

HERMETICALLY-SEALED COSMETIC COMPACT

BACKGROUND OF INVENTION

1. Field of Invention

This invention relates generally to compacts for cosmetics, and more particular to a compact for a cosmetic in cream or paste form that includes volatile agents, the compact being hermetically sealed to extend the shelf-life of the cosmetic.

2. Status of Prior Art

The term makeup, in the sense this term is normally used, encompasses the full range of cosmetics employed by women to beautify and color their face. Included in this term are pressed facial powders, blushes, mascara and eye shadow. These cosmetics, when stored in a compact, may be applied by a finger to a user's face, or by brushes, sponges or other applicators.

A compact which stores a viscous cosmetic in paste or cream form that includes volatile agents, must take into account that it cannot safely be exposed to the atmosphere for a prolonged period, for the cosmetic will then dry out and cease to be useable. Though the typical compact includes a cover or lid that closes the compartment containing the cosmetic, this closure is not air-tight; hence should the cosmetic be stored in the compact it will gradually dry out.

Should the cover of the compact be of the screw-on type and is tightly screwed onto a case containing a cosmetic cream or paste, this would not ensure that the cosmetic will not gradually dry out, for the only seal that is effective to prevent evaporation from the compact is a hermetic seal.

In the design of a compact for storing a cosmetic cream or paste, one need not consider what happens when the compact is in the hands of a user, for the typical user exhausts the cosmetic in a matter of weeks. A major concern in the design of a cosmetic compact is its shelf-life, for the compact may be on the shelf of a retail establishment for as long as six months or more before it is sold to a user. It is important therefore that at the time the compact is finally sold, that the cosmetic cream or paste contained therein be in acceptable condition.

The present invention is directed to a compact for packaging a cosmetic in viscous cream or paste form that includes volatile agents, the compact having a case in which the cosmetic is stored and a lid hinged to the case to close the compact.

The advantage of a compact having hinged lid over a screw-type lid is that the lid may be provided on its inner surface with a mirror. This makes it possible for a user, while holding the case of the compact in her hand, to view her face in the mirror of the swung-open lid as she applies the cosmetic. One such compact is shown in the U.S. Pat. No. 5,107,871 to Butcher in which the hinged lid of the compact is provided with a mirror.

The advantage of a compact having a removable screw-on lid is that the lid can be turned manually to tighten its engagement with a sealing ring in the case of the compact to effect a hermetic seal. No such tightening action is normally possible with a compact having a hinged lid which swings down to close the compact.

On the other hand, a compact provided with a hinged lid which is never detached from the compact is far easier for a user to operate than a compact which makes it necessary for a user to unscrew the lid to obtain access to the cosmetic, to then place the unscrewed lid at a site where it will not be overlooked, and to thereafter screw back the lid.

SUMMARY OF INVENTION

In view of the foregoing, the main object of this invention is to provide a compact adapted to package a cosmetic in paste or cream form that includes volatile agents, the compact having a hinged lid which when closed acts to hermetically seal the cosmetic package.

A salient feature of a cosmetic compact in accordance with the invention is that it retains the practical advantages of a hinged-lid type of cosmetic compact, yet effects a hermetic seal comparable to that obtainable with a screw-on lid that can be manually tightened.

More particularly, an object of this invention is to provide a cosmetic compact which includes an elastomeric sealing collar surrounding a cosmetic stored in a shell anchored in the case of the compact, which collar, when the lid is closed is engaged and subjected to downward pressure by a pressure ring anchored in the lid to effect a hermetic seal, this action causing the collar to exert an upward pressure to tighten the seal.

Also an object of the invention is to provide a compact whose case and lid are moldable of synthetic-plastic material whereby the compact may be mass produced at relatively low cost.

Briefly stated, these objects are attained by a compact adapted to package a cosmetic in paste or cream form that includes volatile agents, the cosmetic package being hermetically sealed to prolong its shelf-life. The compact is provided with a case on whose base is anchored a cylindrical shell for storing the cosmetic. Surrounding the shell is an elastomeric sealing collar having a circular array of elastomeric legs extending from its lower edge and resting on the base of the case.

Formed on the inner surface of the lid is a circular pressure ring which when the lid is swung down to close the compact then engages and applies downward pressure to the upper edge of the sealing collar to hermetically seal the cosmetic stored in the shell. This action compresses the legs which then exert an upward pressure on the collar to tighten its engagement with the ring and thereby strengthen the seal.

BRIEF DESCRIPTION OF DRAWINGS

For a better understanding of the invention, as well as other objects and features thereof, reference is made to the accompanying drawings wherein.

DESCRIPTION OF DRAWING

Figure 3:
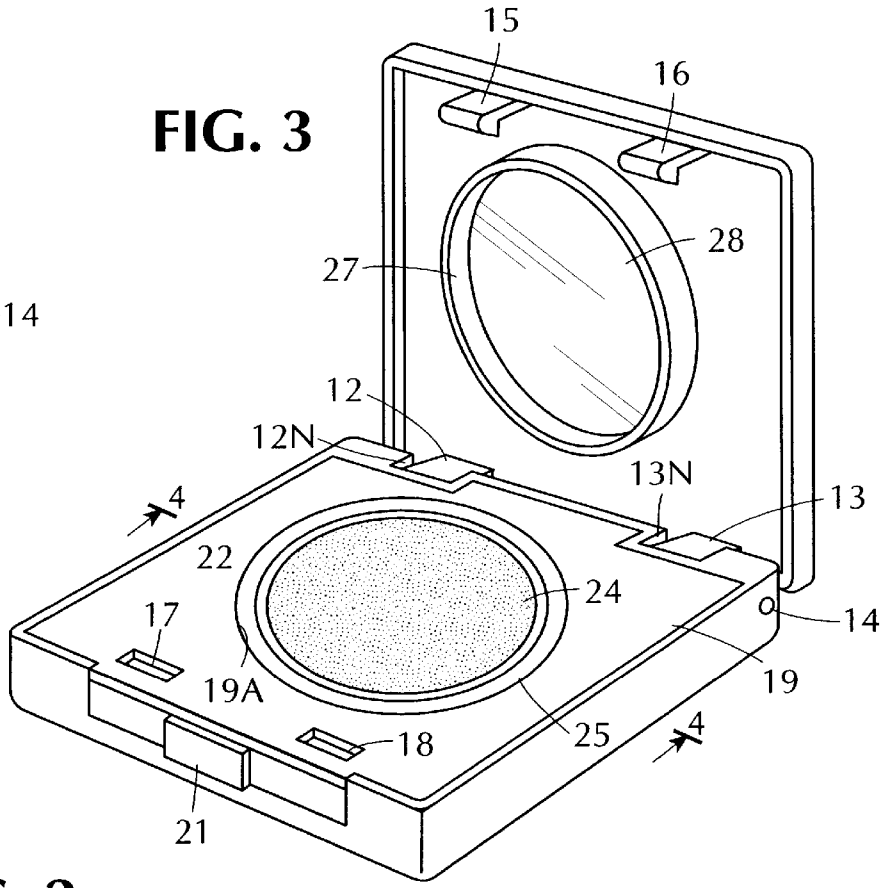
FIG. 3 shows the compact with its lid open to provide access to the cosmetic stored in the case of the compact.
Figure 2:
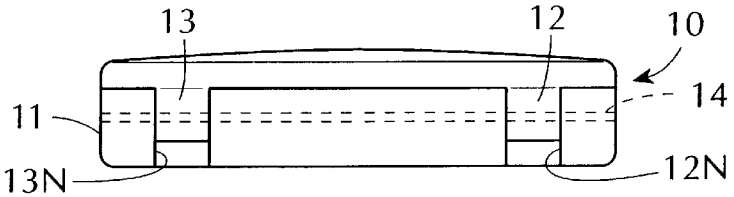
FIG. 2 is a rear view of the closed compact.
Figure 1:
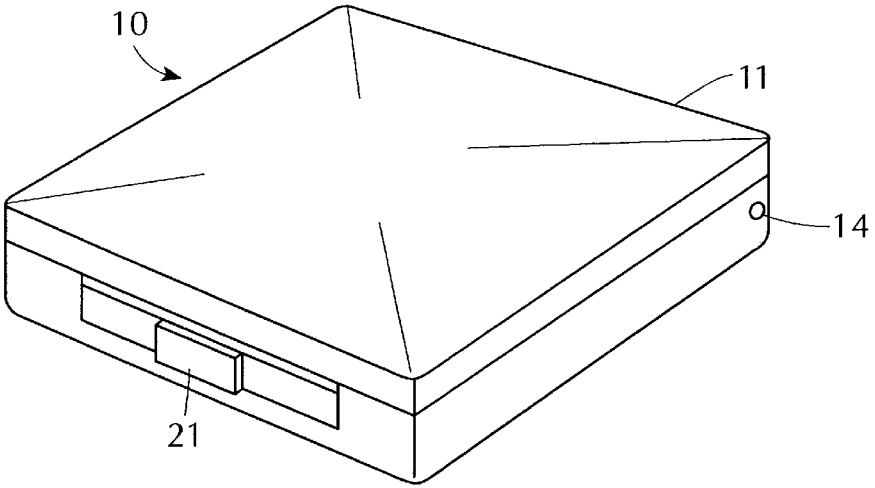
FIG. 1 is a perspective view of a compact having a hinged lid in accordance with the invention, the hinged lid being closed.

Referring now to FIGS. 1, 2 and 3, the main components of a cosmetic compact in accordance with the invention are a square case 10 and a square lid 11 hinged to the case. Both the case and lid are molded of high-strength synthetic plastic material, such as polycarbonate or polypropylene. As best seen in FIG. 2, the rear end of lid 11 is provided with a pair of gudgeons 12 and 13. These are received in complementary notches 12N and 13N in the rear end of case 11 and are held therein by a pivot pin 14, thereby hinging the lid to the case.

The front end of lid 11 at its inner side is provided with a pair of projecting lugs 15 and 16. These lugs, when lid 11 is swung down to then close the compact, are received in slots 17 and 18 in the cover 19 of case 10 to enter a latching socket 20 (see FIG. 6). Latching socket 20 which is spring biased includes a projecting button 21 which when pushed in then releases the lugs to unlatch the lid. Thus when the lid is swung down, the lid is latched to shut the compact, and when button 21 is pressed in, the lid is unlatched and can then be swung open.

Figure 6:
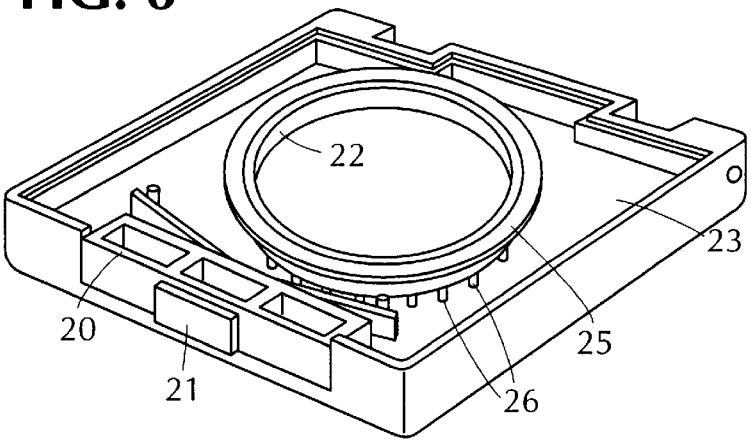
FIG. 6 is a perspective view of the case with its cover removed.
Figure 4:
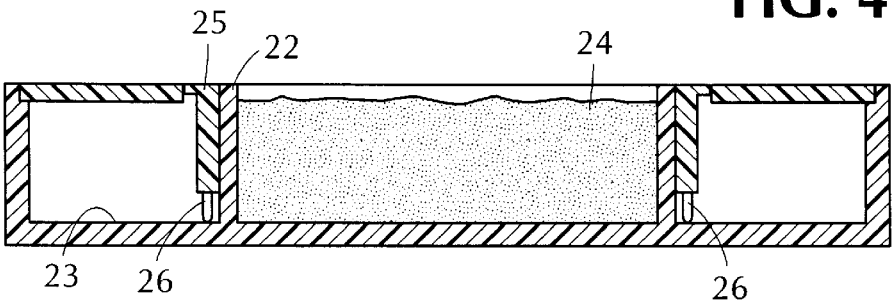
FIG. 4 is a transverse section taken through the case of the compact in the plane indicated by line 4—4 in FIG. 3.

Case 10, as best seen in FIG. 6 in which cover 19 (shown separately in FIG. 9) is removed from the case, is provided with a cylindrical shell 22 integral with the base 23 of the case. Hence shell 22 has a closed bottom and an open top. Stored in shell 22 is a cosmetic supply 24 in paste or cream form as shown in FIGS. 3 and 4. This supply includes volatile agents and it is therefore necessary to hermetically seal the supply, otherwise the cosmetic will dry out on the shelf even though the compact is shut.

Surrounding shell 22 and snugly received thereon is a cylindrical sealing collar 25 formed of elastomeric material, such as silicone rubber or other elastic material that is stretchable and compressible yet always resumes its normal form when pressure applied thereto is released.

Figure 5:
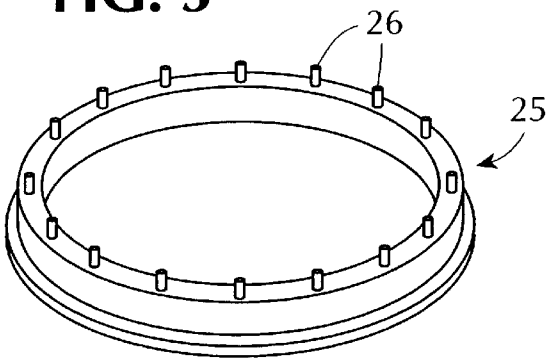
FIG. 5 is a separate view of the sealing collar included in the compact, the collar being shown upside down.
Figure 7:
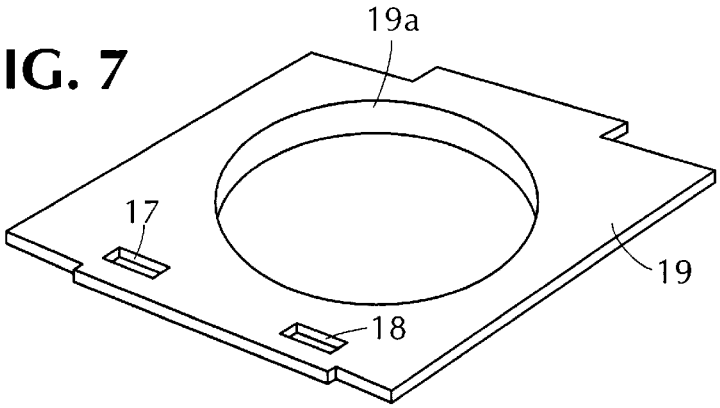
FIG. 7 separately shows the cover of the case.

As best seen in FIG. 5, elastomeric collar 25 is provided with a circular array of tiny legs 26 which project from the lower edge of the collar and are parallel with the longitudinal axis of the collar. When the collar is mounted on the shell, legs 26, as shown in FIG. 4, then rest on base 23 of case 10.

Cover 19 is provided with a circular opening 19A and when cover 19 is fitted onto case 10, as shown in FIG. 3, opening 19A is then in registration with collar 25 surrounding shell 22 to expose the cosmetic supply 24.

Figure 8:
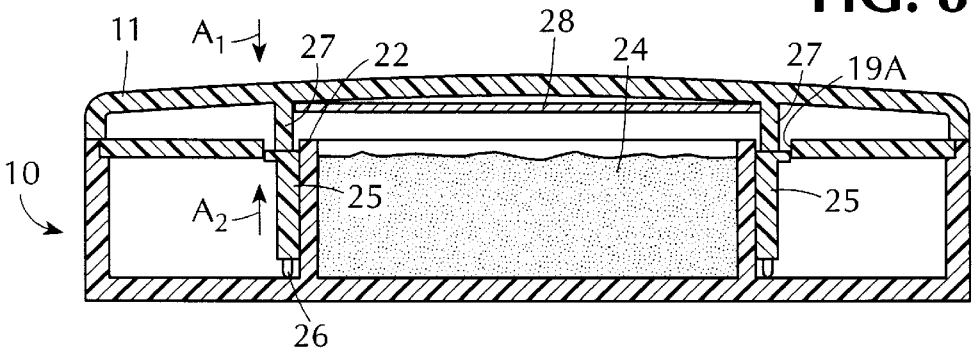
FIG. 8 illustrates the pressure relationships of the sealing collar and the pressure ring engaging the collar.

Lid 11 is provided with a pressure ring 27 integral with the inner surface of the lid. The diameter of ring 27 matches that of sealing collar 25 so that when lid 11 is swung down to shut the compact, ring 27 then engages the upper edge of collar 25 and applies downward pressure thereto, as indicated by arrow $A_1$ in FIG. 8. This downward pressure applied to sealing collar 25 acts to compress projecting legs 26 which are interposed between the lower edge of collar 25 and base 23 of case 10 to produce an upward pressure as the legs seek to regain their normal length. This upward pressure exerted by the legs as they seal to regain their normal length, as indicated by arrow $A_2$, acts to press the upper edge of collar 25 against pressure ring 27.

Thus when lid 11 is closed, this causes pressure ring 27 to engage and press downwardly against the upper edge of sealing collar 25 to effect a hermetic seal of the cosmetic supply 24 within the cylindrical shell 22. This seal is tightened and perfected by the upward pressure applied to the collar as legs 26 seek to regain their normal length. When the lid is raised to open the compact, the legs resume their normal length, thereby preparing the sealing collar for the next closure of the compact. Because of the tight hermetic seal effected by the sealing collar, the shelf-life of the cosmetic compact is prolonged, for the volatile agents in the cosmetic are not permitted to escape as long as the compact is shut.

Nested within circular pressure ring 27 is a disc-shaped mirror 28, as shown in FIG. 3. Hence when a user holding case 10 of the open compact in one hand applies cosmetic taken from the supply to her face, she can then look into the mirror to see how the make-up is being applied. In practice, case 10 may be provided with a compartment to accommodate an applicator for the cosmetic.

While there has been shown and described a preferred embodiment of a hermetically-sealed cosmetic compact in accordance with the invention, it will be appreciated that many changes may be made thereon without departing from the spirit of the invention.

I claim:

1. A compact adapted to sealably package a cosmetic in paste or cream form that includes a volatile agent whereby the package has a prolonged shelf-life, said compact comprising:

A. a case having a base on which a cylindrical shell is anchored to store a supply of the cosmetic;

B. an elastomeric sealing collar having an upper and a lower edge surrounding the shell, said collar having a circular array of elastomeric legs that are compressible projecting from the lower edge and resting on the base of the case; and C. a lid hinged to the case having an inner surface on which is anchored a pressure ring that when the lid is swung down to close the compact then engages the upper edge of the collar to apply downward pressure thereto effecting a hermetic seal of the cosmetic stored in the shell surrounded by the collar, the downward pressure acting to compress the legs which then exert an upward pressure to tighten the engagement between the collar and the ring and thereby strengthen the seal.

2. A compact as set forth in claim 1, in which the case and the lid are molded of synthetic plastic material.

3. A compact as set forth in claim 2, in which the lid is provided with a pair of lugs, and said case is provided with a spring-biased socket to latch the lugs when the lid is closed.

4. A compact as set forth in claim 1, in which the case is provided with a cover having an opening therein in registration with the collar.

5. A compact as set forth in claim 1, in which the collar is formed of silicone rubber.

6. A compact as set forth in claim 1, in which said lid is provided at one end with a pair of gudgeons which are received in complementing notches in the case, a pivot pin extending through said gudgeons to hinge the lid to the case.

* * * * *